US009464525B2

(12) United States Patent
Fujiki et al.

(10) Patent No.: US 9,464,525 B2
(45) Date of Patent: Oct. 11, 2016

(54) INTERNAL GEAR PUMP HAVING AN ECCENTRIC INNER ROTOR AND OUTER ROTOR HAVING TEETH NON-TROCHOID TOOTH PROFILES AND A MOVING CENTER OF THE OUTER ROTOR

(71) Applicant: YAMADA MANUFACTURING CO., LTD., Kiryu-shi, Gunma-ken (JP)

(72) Inventors: Kenichi Fujiki, Isesaki (JP); Masato Izutsu, Isesaki (JP)

(73) Assignee: YAMADA MANUFACTURING CO., LTD., Kiryu-Shi, Gunma-Ken (JP)

( * ) Notice: Subject to any disclaimer, the term of this patent is extended or adjusted under 35 U.S.C. 154(b) by 286 days.

(21) Appl. No.: 13/670,365

(22) Filed: Nov. 6, 2012

(65) Prior Publication Data

US 2013/0115124 A1 May 9, 2013

(30) Foreign Application Priority Data

Nov. 8, 2011 (JP) ..... 2011-244511

(51) Int. Cl.
*F01C 1/00* (2006.01)
*F04C 2/08* (2006.01)
*F04C 2/10* (2006.01)

(52) U.S. Cl.
CPC ..... *F01C 1/00* (2013.01); *F04C 2/084* (2013.01); *F04C 2/102* (2013.01)

(58) Field of Classification Search
CPC ..... F01C 1/00; F04C 2/084; F04C 2/102; F04C 2230/602; F04C 2/086; F01M 2001/0238
USPC ..... 418/166, 171, 150, 164, 169, 170
See application file for complete search history.

(56) References Cited

U.S. PATENT DOCUMENTS

2006/0239848 A1* 10/2006 Hosono ..... F04C 2/102 418/150
2008/0107557 A1* 5/2008 Ono et al. ..... 418/171
2010/0129253 A1 5/2010 Nunami et al.

FOREIGN PATENT DOCUMENTS

JP 05-006170 U 1/1993
JP H 8-128392 A 5/1996
JP 2011-17318 A 1/2011
WO WO 2011/058908 A1 5/2011

OTHER PUBLICATIONS

English Machine Translation of JP 08-128392 A (tranlated on May 30, 2014).*
English Machine Translation of JP H08 128392 A (11 pages total, translated on Jan. 22, 2015).*
European Office Action dated Jul. 15, 2013.
Japanese Office Action dated Apr. 28, 2015.

* cited by examiner

*Primary Examiner* — Kenneth Bomberg
*Assistant Examiner* — Paul Thiede
(74) *Attorney, Agent, or Firm* — McGinn IP Law Group, PPLC

(57) ABSTRACT

An internal gear pump in which an inner rotor and an outer rotor are arranged in a rotor housing chamber. A deepest meshing section is located in the vicinity on a line connecting a center of the inner rotor and a center of the outer rotor. A center of the rotor housing chamber is offset, from a position in which the center and the center of the outer rotor coincide with each other, to the deepest meshing section side by an amount smaller than a tip clearance, which is a gap between the tooth tip of the inner rotor and the tooth tip of the outer rotor in the vicinity of a seal land between a terminal end side of an intake port and a start end side of a discharge port.

1 Claim, 4 Drawing Sheets

ROTOR HOUSING CHAMBER
BEFORE OFFSET

ROTOR HOUSING CHAMBER
AFTER OFFSET

Fig.4B (γ) PART ENLARGEMENT (ε) PART ENLARGEMENT m<dt<dr

INTERNAL GEAR PUMP HAVING AN ECCENTRIC INNER ROTOR AND OUTER ROTOR HAVING TEETH NON-TROCHOID TOOTH PROFILES AND A MOVING CENTER OF THE OUTER ROTOR

BACKGROUND OF THE INVENTION

1. Field of the Invention

The present invention relates to an internal gear pump that can improve volume efficiency.

2. Description of the Related Art

Conventionally, there is an internal gear pump including an inner rotor and an outer rotor. Concerning tooth profiles of the inner rotor and the outer rotor, various researches and developments have been conducted and inventions for improving pump efficiency have been devised. As such inventions, there are Japanese Patent Application Laid-open No. S55-148992 and WO2008/111270.

In Japanese Patent Application Laid-open No. S55-148992, teeth of an inner rotor start to push (or start to mesh with) teeth of an outer rotor in a deepest meshing section. Consequently, force is applied to the outer rotor from the deepest meshing section to a front side in a rotating direction of the rotors. In other words, force in a direction substantially lateral to a conveying side, which is a maximum cell volume section, is applied to the outer rotor.

In an oil pump rotor in WO2008/111270, outer tooth profile shapes ($U_{1in}$, $U_{2in}$) of a patented inner rotor are formed by deformation in the circumferential direction ($U_1$, $U_2$) and deformation in the radial direction ($U_{1in}$, $U_{2in}$) applied to tooth profile shapes ($U'_1$, $U'_2$) formed by mathematical curves while maintaining a distance between a radius (RA1) of a tooth tip circle (A1) and a radius (RA2) of a tooth groove circle (A2).

A region where the teeth of the inner rotor and the teeth of the outer rotor mesh with each other is calculated on the basis of the tooth profile shapes of the inner rotor 10 and the outer rotor 20. For example, in an example of an oil pump shown in FIG. 10 disclosed in WO2008/111270, a curve between a tooth groove side meshing point "b" and a tooth tip side meshing point "a" is a region where the inner rotor 10 and the outer rotor 20 mesh with each other.

In other words, when the inner rotor 10 rotates, in outer teeth 11a of the inner rotor 10, the inner rotor 10 and the outer rotor 20 start to mesh with each other at the tooth groove side meshing point "b" (see FIG. 10A of WO2008/111270). Thereafter, the meshing point gradually slides to the tooth tip side of the outer teeth 11a. Finally, the inner rotor 10 and the outer rotor 20 fail to mesh with each other at the tooth tip side meshing point "a" (see FIG. 10B of WO2008/111270).

As explained above, in WO2008/111270, the inner rotor and the outer rotor start to mesh with each other further on a negative side in the rotating direction of the rotors than the deepest meshing section and fail to mesh with each other further on a positive side in the rotating direction of the rotors than the deepest meshing section. Consequently, force is applied to the outer rotor on the front side in the rotating direction of the rotors from the deepest meshing section. The force is force in a direction substantially lateral to a conveyance side, which is a maximum cell volume section.

In Japanese Patent Application Laid-open No. S55-148992, in a trochoid rotor, the inner rotor and the outer rotor start to mesh with each other in the deepest meshing section. Consequently, force is applied to the outer rotor on the front side in the rotating direction of the rotors from the deepest meshing section. The force is applied from the inner rotor to the outer rotor is force in a direction lateral to the conveyance side, which the maximum cell volume section. Therefore, the force is not force in a direction in which a tip clearance on the conveyance side decreases. Therefore, the tip clearance on the conveyance side does not decrease and a leak does not decrease. Therefore, volume efficiency is not improved.

In WO2008/111270, the inner rotor and the outer rotor start to mesh with each other further in a negative position in the rotating direction than the deepest meshing section and finish meshing with each other in a positive position in the rotating direction.

When the deepest meshing section is set as zero, a meshing range extends from the negative side in the rotating direction to the positive side in the rotating direction. As a result, the force applied from the inner rotor to the outer rotor is force in the direction lateral to the conveyance side, which is the maximum cell volume section. The force is not force in the direction in which the tip clearance on the conveyance side decreases. Therefore, the tip clearance on the conveyance side does not decrease and a leak does not decrease. Therefore, volume efficiency is not improved.

SUMMARY OF THE INVENTION

An object of the present invention (a technical problem to be solved) is to reduce, in an internal gear pump, a leak from a discharge side to an intake side and improve volume efficiency (a rate of flow of actual discharge with respect to a theoretical discharge amount) by reducing a tip clearance on a conveyance side.

Therefore, as a result of continuing researches in order to solve the problem, the inventor has solved the problem by devising the present invention. According to a first aspect of the present invention, there is provided an internal gear pump in which an inner rotor and an outer rotor are arranged in a rotor housing chamber, wherein, in the inner rotor and the outer rotor, $e>d/[2(N-2)]$ is satisfied when eccentricity is represented as e, a tooth bottom diameter of the inner rotor is represented as d, and the number of teeth of the inner rotor is represented as N.

According to a second aspect of the present invention, in the internal gear pump according to the first aspect, a deepest meshing section is located in the vicinity on a line connecting the center of the inner rotor and the center of the outer rotor. The center of the rotor housing chamber is offset, from a position in which the center of the rotor housing chamber and the center of the outer rotor coincide with each other, to the deepest meshing section side by an amount smaller than a tip clearance, which is a gap between the tooth tip of the inner rotor and the tooth tip of the outer rotor in the vicinity of a seal land between a terminal end side of an intake port and a start end side of a discharge port.

According to a third aspect of the present invention, in the internal gear pump according to the first or second aspect, a tooth profile of the inner rotor is formed by a curve obtained by combining a plurality of ellipses and circles or high-order curves.

In the first aspect, in the inner rotor and the outer rotor, $e>d/[2(N-2)]$ is satisfied when eccentricity is represented as e, a tooth bottom diameter of the inner rotor is represented as d, and the number of teeth of the inner rotor is represented as N. Therefore, the inner rotor and the outer rotor can include a larger number of teeth than the number of teeth of an inner rotor and an outer rotor having a normal trochoid tooth profile. Therefore, it is possible to improve pump efficiency. The size of the rotors is the same as the size of a rotor drawn by a normal trochoid curve. Therefore, the size of the rotor housing chamber of the housing is the same. It is possible to easily change the rotors to rotors having a large theoretical discharge amount.

In the second aspect, the center position of the rotor housing chamber is offset (changed) to the deepest meshing section side formed by the inner rotor and the outer rotor. Therefore, in the operation of the pump, even if the outer rotor swings from the maximum cell volume side to the deepest meshing section side, the rotation center of the outer rotor can substantially coincide with the center of the diameter of the rotor housing chamber.

A radial clearance between the outer rotor and the rotor housing chamber is uniform along the outer circumference (360°). The rotation of the outer rotor is smoothly performed. A meshing range of the inner rotor and the outer rotor is further in a negative range in the rotating direction than the deepest meshing section. Therefore, a tip clearance between the inner rotor and the outer rotor in the maximum cell volume section on the conveyance side decreases. As a result, it is possible to suppress a leak from the maximum cell volume section and improve volume efficiency.

In the third aspect, the tooth profile of the inner rotor is formed by a curve obtained by combining a plurality of ellipses and circles or high-order curves. Therefore, a joining section is smoothly formed and durability of the rotors is improved. It is possible to reduce sound caused when the rotors mesh with each other. Therefore, silence is also improved.

BRIEF DESCRIPTION OF THE DRAWINGS

FIG. 4B is an enlarged view of a (γ) part of FIG. 4A.

DESCRIPTION OF THE PREFERRED EMBODIMENT

Figure 1:
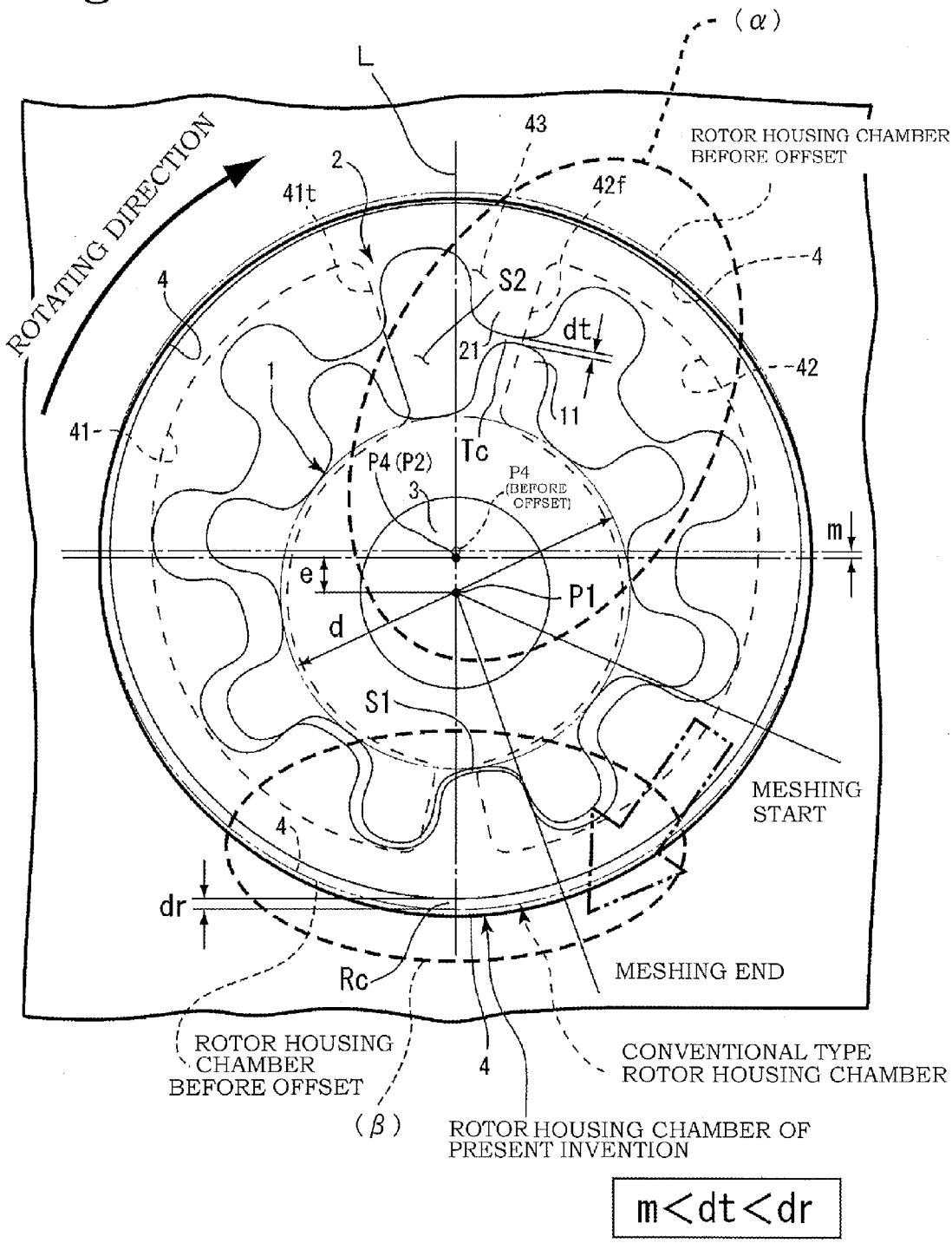
FIG. 1 is a front view after offset of a rotor housing chamber in the present invention.

An embodiment of the present invention is explained below on the basis of the drawings. In the present invention, a pump rotor configures a rotor of an internal gear pump. Specifically, the pump rotor includes an inner rotor 1 and an outer rotor 2 (see FIG. 1). The inner rotor 1 is a gear of an external gear type and the outer rotor 2 is a gear of an internal gear type. In FIG. 1, an arrow of an alternate long and two short dashes line drawn in a range from the start of meshing to the end of meshing indicates force applied from the inner rotor 1 to the outer rotor 2.

The pump rotor refers to a so-called high-volume tooth profile, which realizes an increase in a theoretical discharge amount, rather than the trochoid tooth profile. As the high-volume tooth profile, a tooth profile 11 of the inner rotor 1 is formed by, for example, a curve obtained by combining a plurality of ellipses and circles or high-order curves.

In the present invention, in the pump rotor, the rotation center of the inner rotor 1 is represented as P1, the rotation center of the outer rotor 2 is represented as P2, and the eccentricity of the rotation centers is represented as e. The tooth bottom diameter of the inner rotor 1 is represented as d and the number of teeth of the inner rotor 1 is represented as N. The inner rotor 1 and the outer rotor 2 are configured to satisfy the following expression:

$$e > d/[2(N-2)] \quad \text{[Expression 1].}$$

In a rotor drawn by setting that satisfies the expression, as explained below, the inner rotor 1 and the outer rotor 2 mesh with each other in a negative region in a rotating direction when the position of a deepest meshing section S1 on a line connecting the center P2 of the outer rotor 2 and the center P1 of the inner rotor 1 (hereinafter referred to as reference line L) is zero.

In an inner rotor by a normal trochoid tooth profile in which a range in which the inner rotor 1 and the outer rotor 2 mesh with each other is a positive region in the rotating direction, the following expression is applied:

$$e \leq d/[2(N-2)] \quad \text{[Expression 2].}$$

Available numerical values are specifically applied to the eccentricity e and the tooth bottom diameter d. The number of teeth N of the inner rotor 1 in the present invention and the number of teeth of the inner rotor having the trochoid tooth profile of the conventional type are compared.

TABLE 1

| | Tooth profile of the invention | Trochoid tooth profile |
|---|---|---|
| Eccentricity e | 2.7 mm | 2.7 mm |
| Tooth bottom diameter d | 23 mm | 23 mm |
| Number of teeth N | 7 | 5 |

According to a result of the comparison, the number of teeth N of the inner rotor 1 according to the present invention can be set larger than the number of teeth of the inner rotor of the trochoid type. Therefore, it is possible to improve pump efficiency.

The inner rotor 1 plays a role of a driving gear. The outer rotor 2 is a driven gear that moves following the driving of the inner rotor 1. A driving shaft 3 rotates the inner rotor 1. The inner rotor 1 meshes with the outer rotor 2. The outer rotor 2 rotates following the rotation of the inner rotor 1.

At this point, a position of the start of the meshing of the inner rotor 1 and the outer rotor 2 is present on the rear side in the rotating direction of the deepest meshing section S1 located on the reference line L connecting the center P2 of the outer rotor 2 and the center P1 of the inner rotor 1. The deepest meshing section S1 is a place where the tooth profile 11 of the inner rotor 1 and a tooth profile 21 of the outer rotor 2 mesh with each other most deeply. A position of the end of the meshing is a position delayed by one tooth in the rear in the rotating direction from the position of the start of the meshing (see FIG. 1).

Both of the position of the start of meshing and the position of the end of the meshing of the inner rotor 1 and the outer rotor are in a negative position in the rotating direction, force applied from the inner rotor 1 to the outer rotor 2 is generated in a position on the deepest meshing section S1 side and is force in a direction from the maximum cell volume section S2 to the deepest meshing section S1. In other words, as shown in FIG. 1, force applied from the upper side to the lower side and along the rotating direction acts on the outer rotor 2.

Consequently, on the conveyance side, the outer rotor 2 is pressed against the inner rotor 1. The outer rotor 2 moves to the lower side, whereby a tip clearance Tc on the conveyance side decreases and a radial clearance Rc on the lower side decreases. Specifically, a clearance amount dr of the radial clearance Rc decreases by an amount of a decrease in a clearance amount dt of the tip clearance Tc.

Figure 3A:
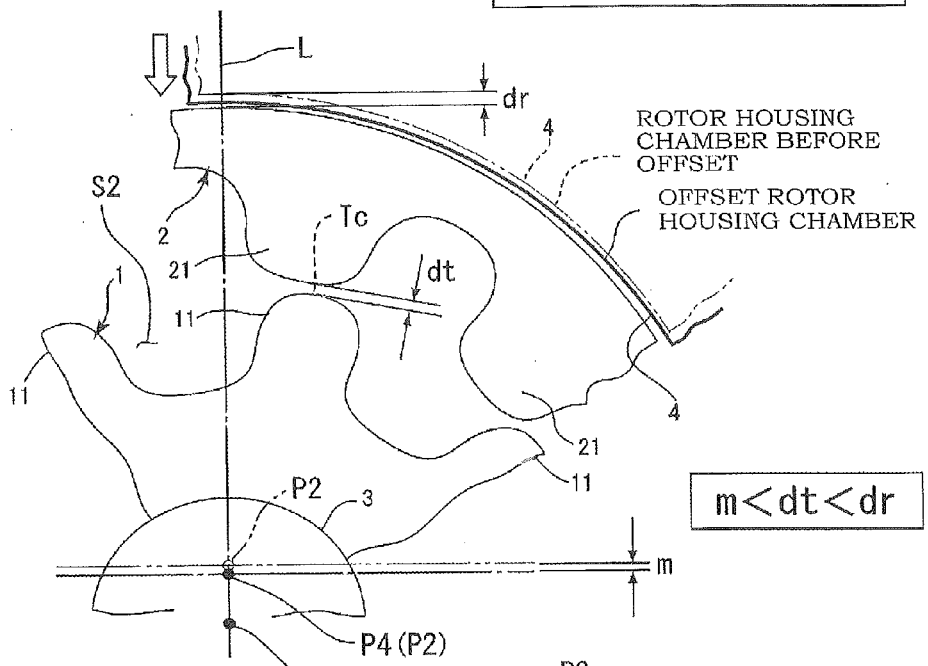
FIG. 3A is an enlarged view of an (α) part of FIG. 1.

The tip clearance Tc refers to a gap between the tooth tip (of the tooth profile 11) of the inner rotor 1 and the tooth tip (of the tooth profile 21) of the outer rotor 2 in the vicinity of a seal land 43, which is a partition between a terminal end side 41*t* of an intake port 41 and a start end side 42*f* of a discharge port 42 on the conveyance side where a cell volume is the largest (see FIG. 1 and FIG. 3A). The radial clearance Rc refers to a gap between the outer circumference of the outer rotor 2 and the inner circumference of a rotor housing chamber 4. The radial clearance Rc needs to be set larger than the tip clearance Tc.

As explained above, the outer rotor 2 is pressed from the inner rotor 1 toward the deepest meshing section S1 side. Therefore, the outer rotor 2 is about to move to the deepest meshing section S1 side.

The tip clearance Tc is set smaller than the radial clearance Rc. Therefore, even if the outer rotor 2 moves in a direction in which the tip clearance Tc on the conveyance side narrows, the outer rotor 2 does not collide against the rotor housing chamber 4 set concentrically with the center of the outer rotor 2 set in the normal (conventional) position. However, the rotor housing chamber 4 is offset to the deepest meshing section S1 side by the narrowed tip clearance Tc. Therefore, the outer rotor 2 rotates in a more stable direction.

Figure 2A:
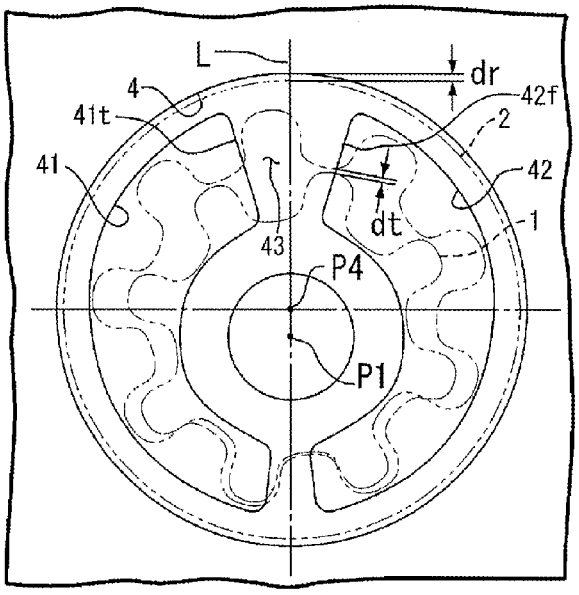
FIG. 2A is a front view before the offset of the rotor housing chamber.

The offset of the rotor housing chamber 4 is explained. First, as a moving amount m in the offset of the rotor housing chamber 4, a state in which the rotation center P2 of the outer rotor 2 and a center P4 of the rotor housing chamber 4 coincide with each other during non-operation (during stop) of the pump is imaginarily set. FIG. 2A shows the imaginarily set state. The inner rotor 1 and the outer rotor 2 are indicated by imaginary lines. The clearance amount dr of the radial clearance Rc is larger than the clearance amount dt of the tip clearance Tc.

Figure 2B:
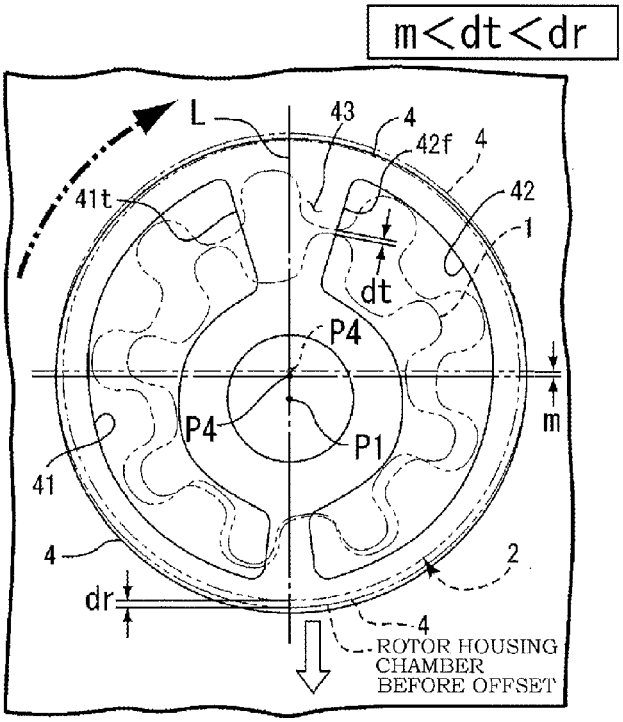
FIG. 2B is a front view after the offset of the rotor housing chamber.
Figure 3B:
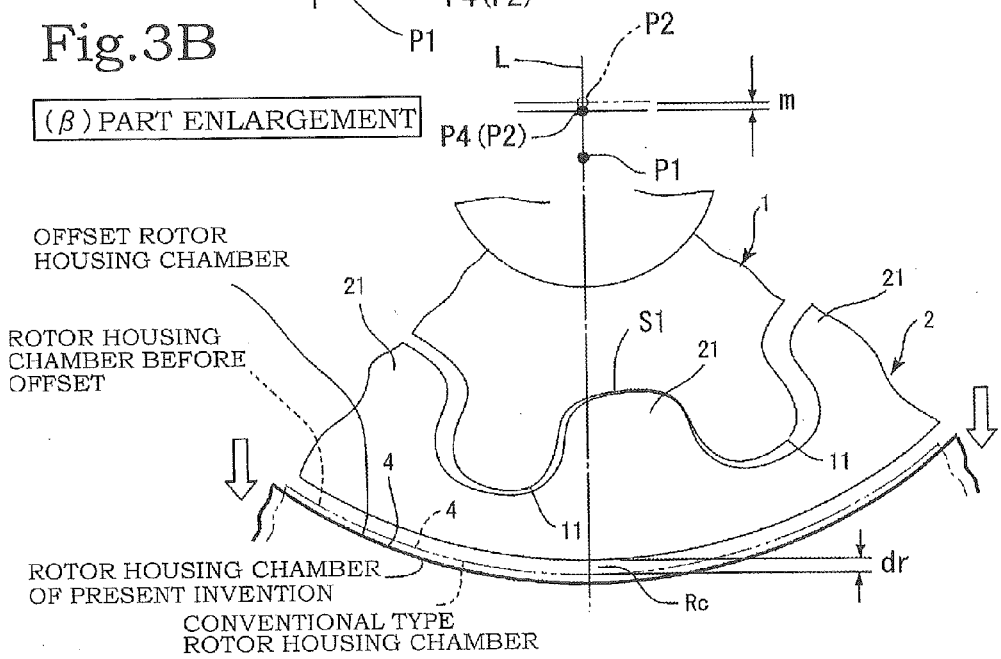
FIG. 3B is an enlarged view of a (β) part of FIG. 1.

FIGS. 1, 2B, and 3 show a state in which the rotor housing chamber 4 is offset. The center P4 of the rotor housing chamber 4 before being offset is in a position same as the rotation center P2 of the outer rotor 2 (see FIG. 2A). However, since the rotor housing chamber 4 is offset, when the pump is not operating, the rotor center P4 and the rotation center P2 are different positions (see FIGS. 2B and 3).

A meshing range of the inner rotor 1 and the outer rotor 2 is a negative range in the rotating direction. Therefore, the outer rotor 2 swings in a direction in which the clearance amount dt of the tip clearance Tc is narrowed (reduced) (see FIG. 3A).

The moving amount m in the offset of the rotor housing chamber 4 is in a range of an amount smaller than the clearance amount dt of the tip clearance Tc in a direction from the maximum cell volume section S2 toward the deepest meshing section S1 or a direction from the rotation center P2 of the outer rotor 2 toward the rotation center P1 of the inner rotor 1 on the reference line L.

The clearance amount dr of the radial clearance Rc is larger than the clearance amount dt of the tip clearance Tc. Therefore, a relation among the moving amount m in the offset of the rotor housing chamber 4, the clearance amount dt of the tip clearance Tc, and the clearance amount dr of the radial clearance Rc is as indicated by the following expression:

$$m<dt<dr \qquad \text{[Expression 3].}$$

Consequently, it is possible to absorb the swing due to the positional transition of the outer rotor 2. The other all tip clearances including the tip clearance Tc are usually set to about 50 μm. The radial clearance Rc is usually set to about 75 μm.

Figure 4A:
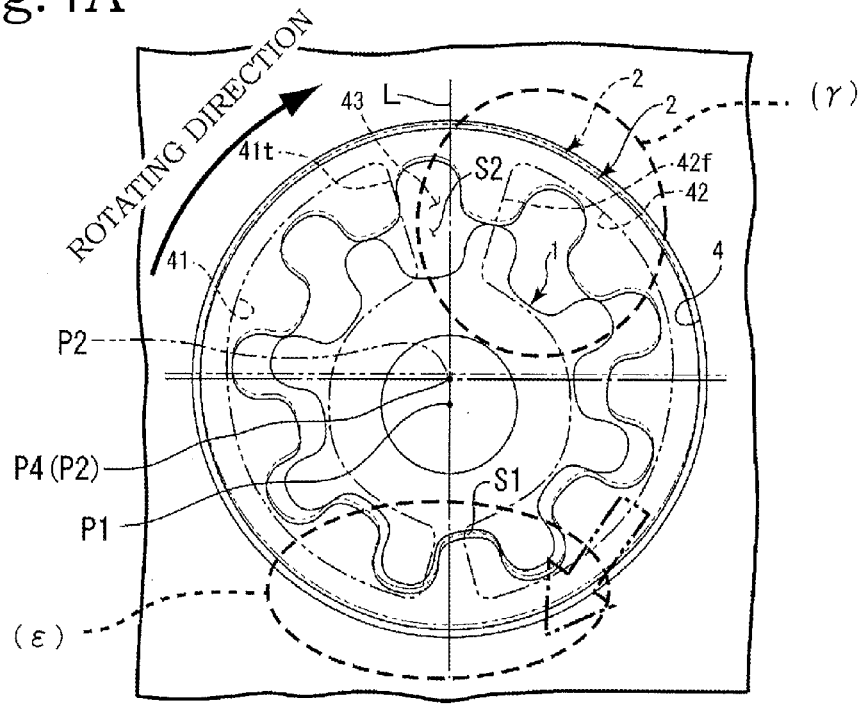
FIG. 4A is a front view of a state in which the center of the offset rotor chamber and the rotation center of an outer rotor coincide with each other in a pump operation state.
Figure 4A:
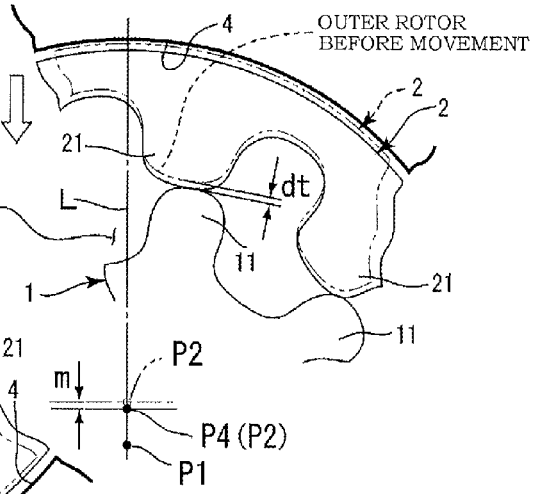
Figure 4C:
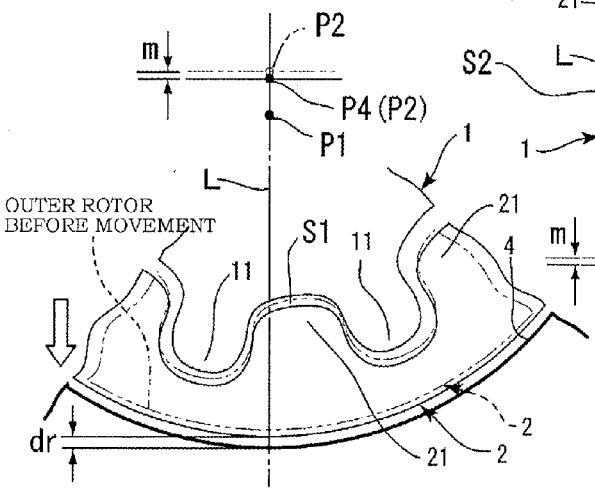
FIG. 4C is an enlarged view of a (ϵ) part of FIG. 4A.

FIG. 4 shows a state in which the rotation center P2 of the outer rotor 2 coincides with the center P4 of the rotor housing chamber 4 when the outer rotor 2 rotates during the pump operation in a state in which the rotor housing chamber 4 is offset. The tip clearance Tc decreases according to the swing of the outer rotor 2 (see FIG. 4B). The center P4 of the rotor housing chamber 4 and the rotation center P2 of the outer rotor 2 approaches. The positions of the center P4 and the rotation center P2 substantially coincide with each other (see FIG. 4A).

Since the position of the rotor housing chamber 4 is offset to the deepest meshing section S1 side, a meshing range of the inner rotor 1 and the outer rotor 2 is in a negative range in the rotating direction. Therefore, in a state in which the outer rotor 2 swings to the deepest meshing section S1 side, the rotation center P2 of the outer rotor 2 and the center P4 of the rotor housing chamber 4 substantially coincide with each other. The radial clearance Rc between the outer rotor 2 and the rotor housing chamber 4 can be set uniform over the entire circumference of the outer rotor 2. Therefore, the rotation of the outer rotor 2 is smoothly performed (see FIG. 4).

As explained above, the internal gear pump according to the present invention is the internal gear pump in which the inner rotor 1 and the outer rotor 2 are arranged in the rotor housing chamber 4. In the internal gear pump, in the inner rotor 1 and the outer rotor 2, $e>d/[2(N-2)]$ is satisfied when eccentricity between the center P1 and the center P2 of the respective rotors 1 and 2 is represented as e, a tooth bottom diameter of the inner rotor 1 is represented as d, and the number of teeth of the inner rotor 1 is represented as N.

In the configuration explained above, the deepest meshing section S1 is located in the vicinity on the line L connecting the center P1 of the inner rotor 1 and the center P2 of the outer rotor 2. The center P4 of the rotor housing chamber 4 is offset, from a position in which the center P4 coincides with the center P2 of the outer rotor 2, to the deepest meshing section side S1 by an amount (the moving amount m) smaller than the tip clearance Tc, which is a gap between the tooth tip of the inner rotor 1 and the tooth tip of the outer rotor 2 in the vicinity of the seal land 43 between the terminal end side 41*t* of the intake port 41 and the start end side 42*f* of the discharge port 42. Further, in addition to the configuration explained above, the tooth profile 11 of the inner rotor 1 is formed by a curve obtained by combining a plurality of ellipses and circles or high-order curves.

In the configuration explained above, in a state in which the rotor housing chamber 4 is not offset, the clearance amount dr of the radial clearance Rc between the rotor housing chamber 4 and the outer rotor 2 is set in a range of an amount larger than the clearance amount dt of the tip clearance Tc. The moving amount m of the rotor housing chamber 4 in the offset is set in a range of an amount smaller than the clearance amount dt of the tip clearance Tc. A relation among the clearance amount dt of the tip clearance Tc, the clearance amount dr of the radial clearance Rc, and the moving amount m in the offset satisfies a relation m<dt<dr.

What is claimed is:

1. An internal gear pump, comprising:

a housing defining a rotor housing chamber and an intake port and an discharge port, the intake port and the discharge port being in fluid communication with the rotor chamber housing, the housing including a seal land disposed in the rotor housing chamber intermediate the intake port and the discharge port;

an inner rotor including teeth; and an outer rotor including teeth, the inner rotor and the outer rotor being disposed in the rotor housing chamber so that the teeth of the inner rotor and the teeth of the outer rotor mesh therewith and the internal gear pump further having a deepest meshing section side located within the rotor chamber housing disposed on a plane passing through the axial center of the inner rotor and the axial center of the outer rotor, each tooth of the inner rotor and the outer rotor has a tooth profile, and the inner rotor and the outer rotor are further arranged in the rotor chamber housing so as to satisfy the equation:

$$e>d/[2(N-2)],$$

where eccentricity is set to e, where a tooth bottom diameter of the inner rotor is set to d, and where the number of teeth of the inner rotor is set to N, wherein the axial center of the rotor housing chamber is movingly offset during operation of the internal gear pump from a position in which the axial center of the rotor housing chamber and the axial center of the outer rotor coincide with each other toward the deepest meshing section side of the rotor chamber housing by an amount smaller than a tip clearance, wherein the tip clearance is a gap between a tooth tip of the inner rotor and a tooth tip of the outer rotor on the seal land between a terminal end side of the intake port and a start end side of the discharge port, the seal land being disposed on another side of the rotor chamber housing opposite to the deepest meshing section side, and wherein the tooth profile of each tooth of the inner rotor and the outer rotor is not a trochoid tooth profile.

* * * * *